United States Patent [19]

Johnson et al.

[11] Patent Number: 4,641,555

[45] Date of Patent: Feb. 10, 1987

[54] PAPER HANDLING SYSTEM

[76] Inventors: Dewey A. Johnson, 599 Summit Ave., St. Paul, Minn. 55102; Gregory P. Hamlin, 1307 Portland Ave., St. Paul, Minn. 55104; Gary W. Schukar, 3494 Rolling View Ct., White Bear Lake, Minn. 55110

[21] Appl. No.: 824,627

[22] Filed: Jan. 31, 1986

[51] Int. Cl.[4] ..... B26D 7/32

[52] U.S. Cl. ..... 83/29; 83/35; 83/256; 83/404.2; 83/88; 83/408; 270/58

[58] Field of Search ..... 83/406, 408, 256, 23, 83/35, 88, 86, 404.2, 29; 270/1.1, 58

[56] References Cited

U.S. PATENT DOCUMENTS

| | | | |
|---|---|---|---|
| 2,517,388 | 8/1950 | Daves | 271/74 |
| 3,224,306 | 12/1965 | Hawley et al. | 198/35 |
| 3,520,395 | 7/1970 | Sablonski, Jr. et al. | 83/23 |
| 3,693,486 | 9/1972 | Maniaci et al. | 83/88 |
| 4,203,334 | 5/1980 | Zettler | 83/23 |
| 4,280,690 | 7/1981 | Hill | 270/58 |
| 4,289,561 | 9/1981 | Holzknecht | 270/58 |
| 4,341,135 | 7/1982 | Ufermann et al. | 83/23 |
| 4,381,107 | 4/1983 | Armiger | 270/58 |
| 4,405,121 | 9/1983 | Hill | 270/58 |
| 4,463,677 | 8/1984 | Kuehfuss | 270/1.1 |
| 4,511,132 | 4/1985 | Müller | 270/58 |

*Primary Examiner*—Donald R. Schran

*Attorney, Agent, or Firm*—Orrin M. Haugen; Thomas J. Nikolai; Frederick W. Niebuhr

[57] ABSTRACT

Disclosed are an apparatus and method for cutting paper sheets into smaller sheet sections and collating the sheet sections. The apparatus includes a table having a longitudinal section, followed by a transverse section. Chains just below the table move a sheet stack longitudinally past a first blade which cuts the stack longitudinally, after which one of the stack portions is elevated above the other and placed on top of the other to combine the portions into a second stack. A second pair of chains moves the second stack in the transverse direction past a second blade which cuts the second stack transversely. One of the stack portions formed by the second cut is elevated above, then placed on top of, the other portion to form a further reduced sized third stack, which then is moved transversely to a third cutting station at which it is cut in the transverse direction. Again, one of the portions created by the third cut is elevated above and placed on the other portion to form a final stack of sheet sections.

23 Claims, 12 Drawing Figures

FIG. 12
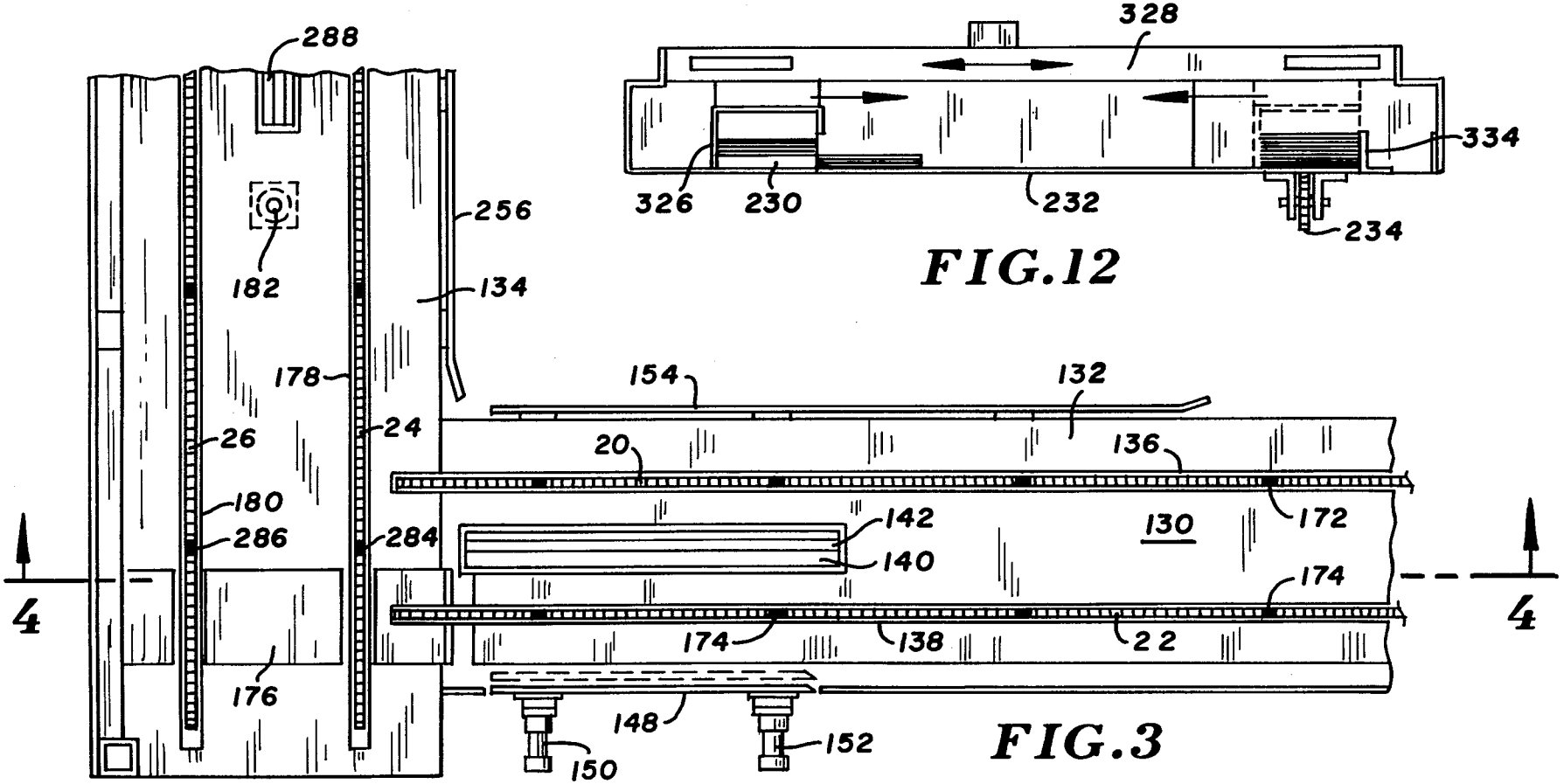
FIG. 3
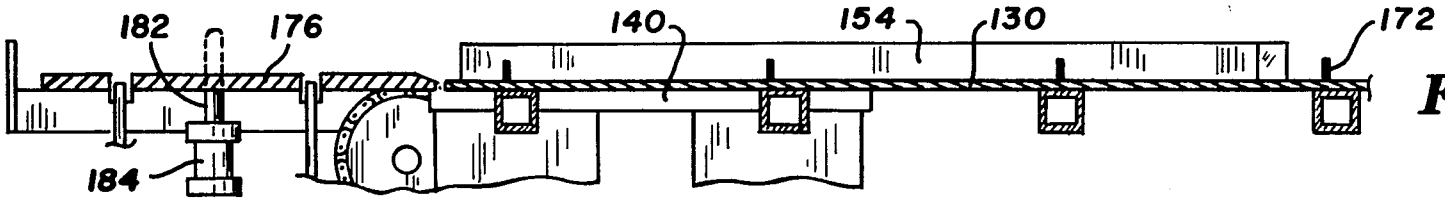
FIG. 4

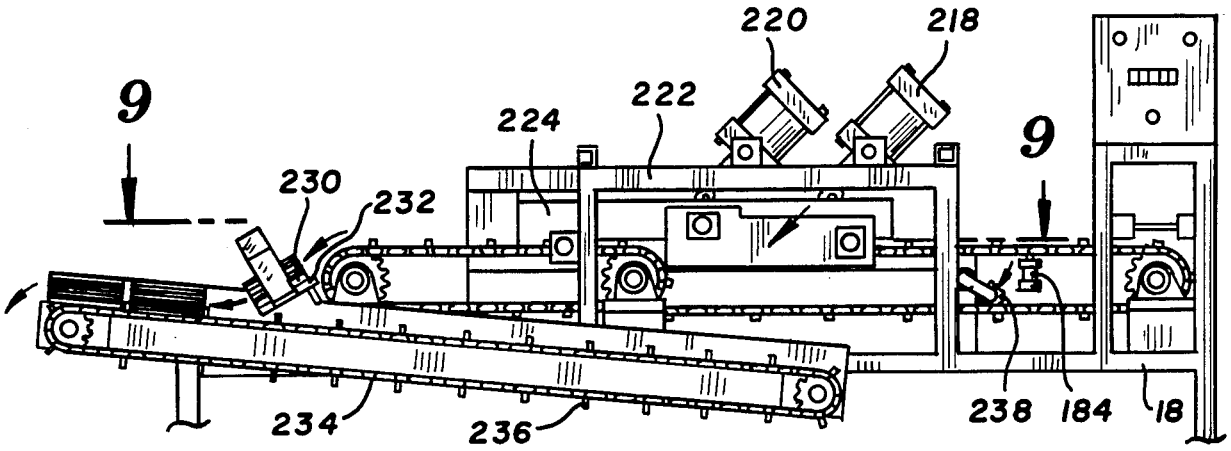
FIG.7
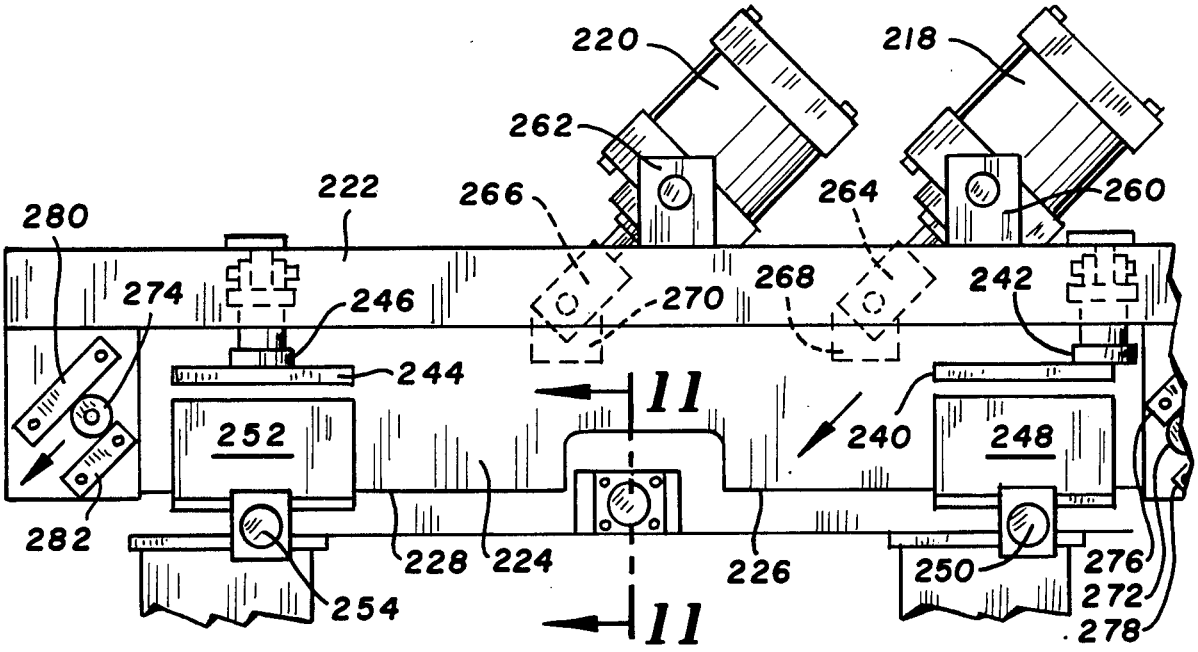
FIG.8
FIG.11
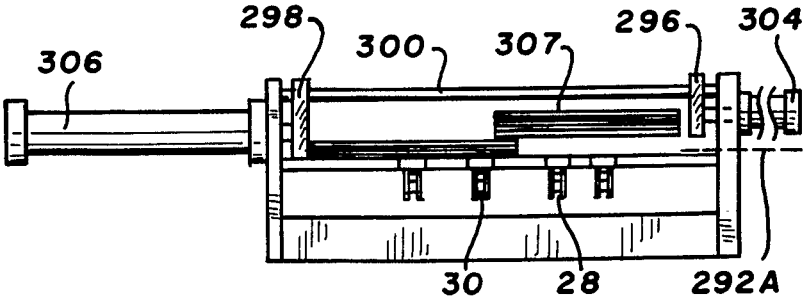

PAPER HANDLING SYSTEM

BACKGROUND OF THE INVENTION

The present invention relates to apparatus for cutting relatively large sheets of material, for example paper or cardboard, into pluralities of smaller, substantially equally sized portions.

Equipment and methods for trimming large sheets of material into smaller sheets are known in the art. For example, U.S. Pat. No. 4,463,677 to Kuehfuss granted Aug. 7, 1984 shows a pile of sheets 10, aligned and then moved longitudinally by slide bars to a transverse strip cutting unit 27, where the pile of sheets is advanced in stages and cut into separate piles of strips. Individual strip piles are bundled together, after which a slide 31 moves them simultaneously toward a cutting unit 33 which, in stages, cuts the strips along a direction transverse to their movement. U.S. Pat. No. 4,203,334 to Zettler shows a conveyor table 4, or alternatively a belt 24, to longitudinally convey a sheet toward a transversely arranged blade 8. Strips cut by blade 8 are stacked, then moved in the transverse direction to be cut by a second blade 13 arranged longitudinally thereby to cross-cut the strips.

An apparatus for sectioning a large rectangular plate into smaller sections is shown in U.S. Pat. No. 4,341,135 to Ufermann et al granted July 27, 1982. A plate is moved longitudinally toward a transverse, pneumatically controlled blade 17 and cut into transverse strips. Pins 35 and 36 align each strip with respect to a pusher 7*a*. The pusher simultaneously moves a number of strips through a shear 2 which includes a blade arranged perpendicular to the direction of strip movement, to cut each strip into smaller sections. U.S. Pat. no. 3,224,306 to Hawley et al granted December 21, 1965 shows rotary cutters 7 and 8 for dividing a sheet 1 into longitudinal strips. The strips are stacked between divider plates 72–76, and are moved by pin cogs 12 mounted on a conveyor 9 toward further rotary cutters 15 and 16, arranged to cut parallel to the direction of strip movement. The strips are cut into individual cards, which are conveyed by belt twisters 18 into accumulators 29, after which the cards moved across a collating table 26 and thereby collated.

While perhaps satisfactory in certain respects, none of the above-described systems addresses the need for a simple and reliable apparatus for handling sheet material at high speed.

It is therefore an object of the present invention to provide an apparatus particularly well adapted for separating sheet material into smaller sections and collating the smaller sections at high speed.

It is a further object of the invention to provide a sheet material handling apparatus having a minimum number of moving parts for enhanced reliability.

Yet another object of the invention is to provide apparatus for using gravity in collating two separate stack sections into a single stack.

SUMMARY OF THE INVENTION

To meet these and other objects, there is provided an apparatus for dividing sheets of material into pluralities of comparatively smaller sheet sections and for collating the smaller sheet sections.

The apparatus includes means forming a longitudinally directed first path, and a transversely directed second path beginning at a downstream end of the first path. A first conveying means moves a first stack of sheet material longitudinally on the first path. Each first stack includes at least one sheet, and all sheets in the stack are aligned in a selected orientation. A first cutting means is provided along the first path for cutting the first stack in the longitudinal direction to form two first stack portions.

The first conveying means moves the first stack portions simultaneously and longitudinally on the first path from the first cutting means to a first collating station at the downstream end of the first path, thereby to elevate one of the first stack portions above the other first stack portion. A first alignment means at the first collating station vertically aligns the first stack portions, with the elevated first stack portion directly on top of the other first stack portion, thereby combining the stack portions into a single second stack. The first alignment means also includes a second conveying means that moves the second stack in the transverse direction on the second path.

A second cutting means along the second path cuts the second stack in the transvrse direction to form two second stack portions. The second conveying means moves the second stack portions simultaneously and transversely on the second path from the second cutting means to a second collating station, thereby to elevate one of the second stack portions above the other second stack portion.

A second alignment means is provided at the second collating station, including a pre-merging means for moving the elevated one of the second stack portions toward the other second stack portion in the longitudinal direction, to cause the elevated second portion to at least slightly overlap the other second stack portion. The second alignment means also includes a merging means, beyond the pre-merging means, for merging the second stack portions to form a single third stack of sheet sections.

The apparatus further can include a third conveying means for moving the third stack on said second path beyond the second collating means. A third cutting means is then provided along the second path, downstream of the second cutting means, for cutting the third stack in the transverse direction to form two third stack portions.

The third conveying means moves the third stack portions simultaneously and transversely on the second path from the third cutting means to a third collating station, thereby to elevate one of the third stack portions above the other third tack portion. A third alignment means is provided at the third collating station for merging the third stack portions into a single fourth stack of sheet sections.

The preferred means for forming the first and second paths is a table having a first longitudinal section and a second transverse section. The conveying means preferably comprise pairs of endless chains mounted below the table.

A pair of first endless chains, mounted to move in the longitudinal direction and running substantially the length of the first path, comprise the first conveying means. The first chains carry a plurality of first tabs spaced apart from one another a distance greater than the longitudinal dimension of the first stack, and arranged in transversely aligned first tab pairs. One such tab pair engages the trailing transverse edge of the first stack in order to move it along the first path with the first chains.

Preferably, a pair of second endless chains also is mounted below the table, running transversely substantially the distance between the first and second collating stations, thereby to comprise the first alignment means and the second conveying means. The second chains carry spaced apart second tabs arranged in longitudinally aligned second tab pairs which engage the trailing longitudinal edges of the first stack portions to merge them into the second stack, then convey the second stack along the second path. The third conveying means preferably is comprised of a third pair of endless chains, similar to the second pair but closer to one another.

The first cutting means preferably includes a first knife with a longitudinally extended balde and means for supporting the blade over the table for movement toward and away from the table. The second and third cutting means are comprised of a second knife having second and third transversely extended blades, and means for supporting the knife over the table for movement toward and away from it. All blades are moved toward and away from the table at a 45° angle with respect to the table, thus to introduce a shearing component for improved cutting. The means to support the knives includes rotatable bearings mounted with respect to the knives, and elongate guide bars mounted at the 45° angle and positioned to contain the bearings. The blades are raised and lowered with first, second and third pneumatic cylinders, respectively.

The first and second collating stations can include first and second ramps, respectively, formed in the table. The first ramp is directed longitudinally downstream and upward and positioned to encounter only the elevated first stack portion as the first stack portions enter the first collating station. Similarly, the second ramp is positioned to encounter only the elevated second stack portion. However the second ramp is directed transversely downstream and upward.

The preferred pre-merging means includes a first platen mounted at the second collating station, and a fourth pneumatic cylinder to reciprocate the first platen longitudinally into and out of the second path. The first platen is positioned to engage the outside transverse edge of the elevated second stack portion and move it longitudinally to cause overlap of it and the other second stack portion.

The merging means can include second and third opposed platens downstream of the first platen, and fifth and sixth pneumatic cylinders for reciprocating the second and third platens, respectively, longitudinally into and out of the second path. The second and third platens are positioned to engage the outside transverse edges of the elevated second stack portion and the other second stack portion respectively, and to move the stack portions simultaneously longitudinally toward each other to merge them to form the third stack.

A single electric motor can drive all of the endless chains simultaneously. If desired, a clutch or adjustment means is included to vary the speed of the first chain pair with respect to the second and third chain pairs.

A plurality of cams, rotated by the electric motor, can engage and disengage, at selected times, each one of the six pneumatic cylinders.

The apparatus of the present invention can be used in a process for dividing sheets of material into pluralities of comparatively smaller sheet sections and collating the smaller sheet sections, including the steps of:

(1) Aligning one or more sheets of material in a first stack and in a predetermined orientation;
(2) Conveying the stack in a longitudinal direction to a first cutting station, and cutting the stack in the longitudinal direction to form two first stack portions;
(3) Conveying the first stack portions simultaneously and longitudinally to a first collating tation, and elevating one of the first stack portions above the other;
(4) Pushing the trailing longitudinal edge of the elevated first stack portion in a transverse direction onto the other stack portion to merge the first stack portions into a second stack;
(5) Conveying the second stack in the transverse direction to a second cutting station, and cutting the second stack in the transverse direction to form two second stack portions;
(6) Conveying the second stack portions simultaneously and transversely to a second collating station and elevating one of the second stack portions above the other;
(7) Pushing the elevated second stack portion in the longitudinal direction toward the other second stack portion to cause at least a slight overlap of the elevated second stack portion over the other second stack portion; and
(8) After further transverse movement translation of the second stack portions simultaneously pushing the second stack portions longitudinally toward one another to merge the second stack portions into a third stack of sheet sections.

The process may include the additional steps of:

(1) Conveying the third stack in the transverse direction to a third cutting station downstream of the second cutting station, and cutting the third stack in the transverse direction to form two third stack portions;
(2) Conveying the third stack portions simultaneously and transversely to a third collating station and elevating one of the third stack portions above the other third stack portion; and
(3) Pushing the outside transverse edge of the elevated third stack portion to move the elevated third stack portion longitudinally onto the other third stack portion, to merge the third stack portions into a single fourth stack of reduced size sheet sections.

Among the features and advantages residing in the present invention are the alignment of each cutting means with the directions of sheet motion, and the intermediate collating of sheets which permits the use of only one blade at each cutting station. The blade alignment ensures a precise cut even though the sheet may not be completely at rest at the precise moment of cutting, a particularly important feature when sheets are handled at high speeds. The use of only one blade at each cutting station simplifies the apparatus to enhance reliability, in that the need to align adjacent and parallel blades is eliminated.

Collating of sheets is accomplished in the elevation of one stack portion completely above the other stack portion, and movement of the elevated stack portion above the other so it joins the lower stack portion simply by gravity. Thus there is no need for special devices, such as the belt twisters in the Hawley Patent, to turn sheets on end before collating.

BRIEF DESCRIPTION OF THE DRAWINGS

These and many other features and advantages will become apparent upon review of the following detailed description in light of the drawings, in which:

FIG. 3 is a sectional view taken along the line 3—3 in FIG. 2;

FIG. 4 is a sectional view taken along the line 4—4 in FIG. 3;

FIG. 7 is a side elevation of the apparatus taken along the line 7—7 in FIG. 1;

FIG. 8 is an enlarged view of a portion of FIG. 7;

FIG. 11 is a sectional view taken along the line 11—11 in FIG. 8; and

FIG. 12 is an end elevation of the apparatus taken along the line 12—12 in FIG. 10.

DESCRIPTION OF THE PREFERRED EMBODIMENT

Figure 1:
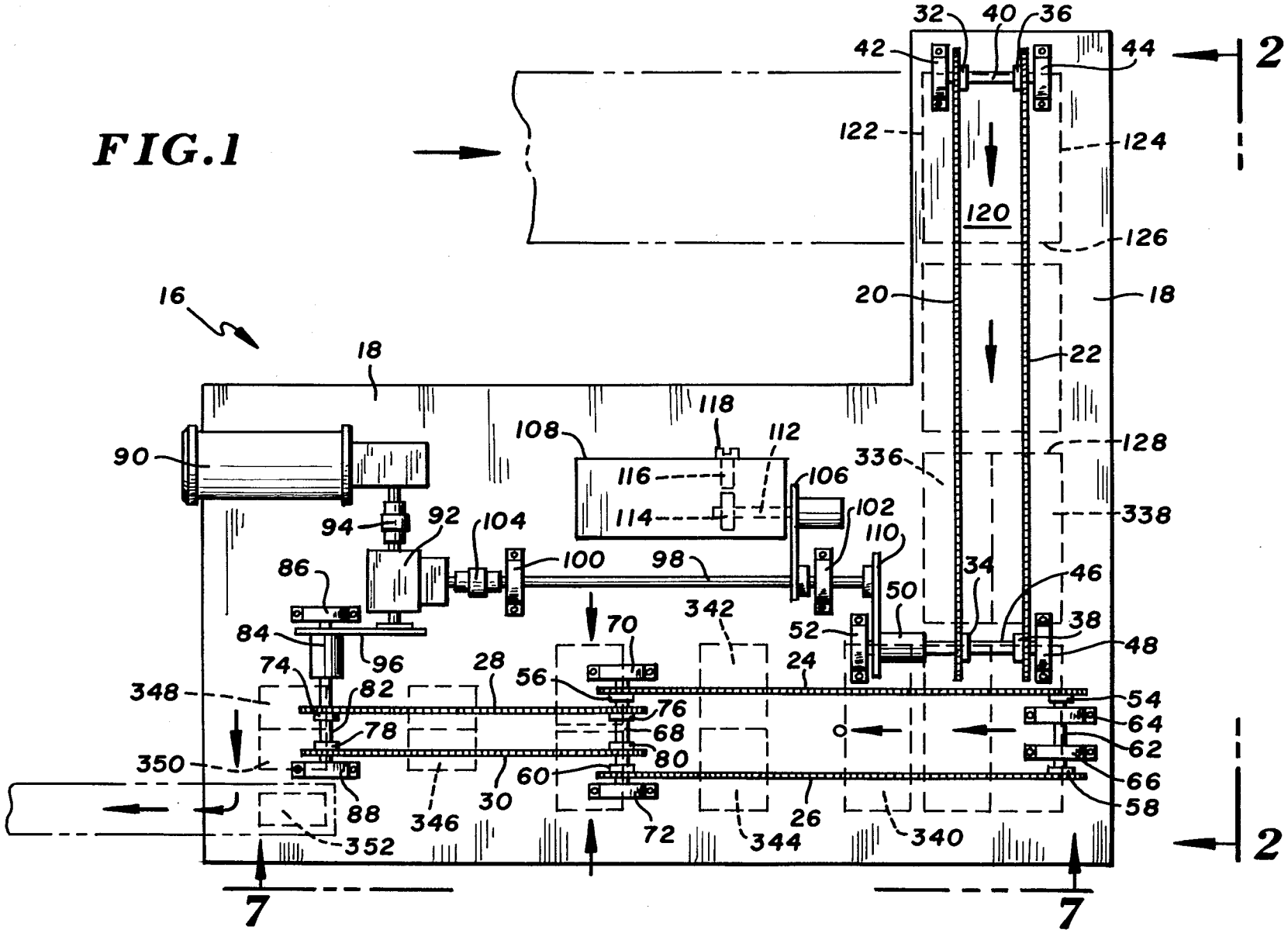
FIG. 1 is a top schematic view of a material sheet cutting and collating apparatus in accordance with the present invention.

Turning to the drawings, there is shown in FIG. 1 a sheet cutting and collating device 16 having a platform 18. Sheet material is moved through the device by three pairs of endless chains: a first pair including first and second longitudinally directed chains 20 and 22; a second pair including third and fourth chains 24 and 26 which are transversely directed; and a third pair including fifth and sixth transversely directed chains 28 and 30.

First chain 20 is carried by a first idler sprocket 32 and a first drive sprocket 34. Similarly, endless chain 22 is carried by second idler and drive sprockets 36 and 38. Idler sprockets 32 and 36 are mounted on an axle 40 which rotates within journal to boxes 42 and 44 mounted to platform 18. The first and second drive sprockets are attached to a drive axle 46 which, in turn, is rotatably mounted with respect to the platform through a journal box 48 and one end of a first clutch 50. The other end of clutch 50 is mounted rotatably by a journal box 52.

Third and fourth chains 24 and 26 are carried on a third idler sprocket 54 and a third drive sprocket 56, and on a fourth idler sprocket 58 and drive sprocket 60, respectively. Idler sprockets 54 and 58 are attached to an axle 62 journaled to platform 18 through journal boxes 64 and 66 positioned between the idler sprockets. Drive sprockets 56 and 60 are supported over the platform on a driven axle 68 journaled to the platform through journal boxes 70 and 72.

Fifth and sixth endless chains 28 and 30 are supported on a fifth drive sprocket 72 and idler sprocket 74, and on a sixth drive sprocket 78 and an idler sprocket 74, and on a sixth drive sprocket 78 and an idler sprocket 80, respectively. Idler sprockets 76 and 80 are mounted on a driven shaft 68, while drive sprockets 74 and 78 are mounted on a drive axle 82 which, along with a second clutch 84, is mounted rotatably to platform 18 through journal boxes 86 and 88.

All six chains are driven by a single electric motor 90. A universal connection 92 is drivably associated with motor 90 through a first coupling 94, and linked to clutch 84 by first endless belt 96 mounted on rollers attached to second clutch 84 and the universal connection, respectively. An elongate shaft 98, supported rotatably over platform 18 through journal boxes 100 and 102, is linked to the universal connection through a second coupling 104 to rotate with motor 90. A second endless belt 106 drivably links shaft 98 and a controller 108. A third endless belt 110 similarly links shaft 98 and first clutch 50.

Mounted in controller 108 is a cam shaft 112 which, through the linkage just described, rotates as motor 90 is driven. Cam shaft 112 carries a series of cams, each of which selectably positions an associated electrical switch contact as it rotates. One such cam and electrical contact are shown at 114 and 116, respectively. Each switch contact is operably associated with a pneumatic hose pair such as that shown at 118. A series of pneumatic hose pairs originate at controller 108, each pair terminating at one of a plurality of pneumatic cylinders used in device 16, as will be later explained.

Shown in broken lines, and at successive positions in device 16, is a rectangular first sheet stack 120 which preferably consists of a single sheet of material. Stack 120 has a first longitudinal edge 122 which is the lead edge as the sheet material moves transversely, a second or trailing longitudinal edge 124, a first transverse edge 126 which is the lead edge as stack 120 travels longitudinally, and a trailing transverse edge 128. Stack 120 is loaded into device 16 substantially horizontally and in a selected orientation in which the longer edges of the rectangular stack are directed longitudinally. Stack 120, and smaller stacks into which it is cut and collated, remain in this predetermined orientation throughout processing by device 16.

Figure 2:
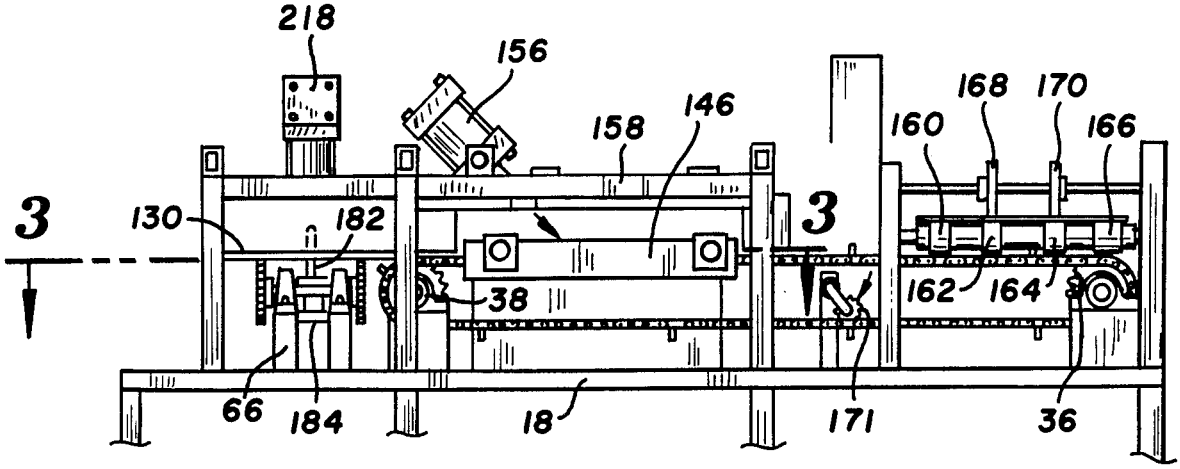
FIG. 2 is a side elevation of the apparatus, taken along the line 2—2 in FIG. 1.

As seen from FIGS. 2-4, device 16 includes a table 130 supported above platform 18, having a longitudinal table section 132 and a transverse table section 134 that provide longitudinal and transverse paths for stacks of material. First and second longitudinal slots 136 and 138 are formed in table 130 directly above first and second chains 20 and 22, respectively. Also formed in the table, at a first cutting station, is a first anvil 140 having an elongate groove 142 to accommodate a longitudinal blade 144 of a first knife 146 (FIG. 2) as it cuts first stack 120. Also at the first cutting station is a longitudinal platen 148, movable transversely into and out of the longitudinal path by a pair of first platen pneumatic cylinders 150 and 152. When moved inward, platen 148 pushes first stack 120 against a reference surface provided by a longitudinal wall 154, thus to center the stack for cutting.

From FIG. 2 it is seen that first knife 146 is reciprocated toward and away from table 130 by a first cutting pneumatic cylinder 156, inclined relative to the table at an angle of about 45°, and supported over the table by a first horizontal frame member 158. Idler sprockets 171, on a spring loaded arm, prevent undue slack in chains 20 and 22.

Stacks of sheets such as first stack 130 are initially fed to device 16 and placed in the selected orientation by a feeding device including four lower belts 160, 162, 164 and 166, and two upper belts 168 and 170 opposed to lower belts 162 and 164. the stacks are fed from between the upper and lower belts, and descend to table 130 due to gravity.

A series of first tabs 172 are carried on first chain 20, spaced apart from one another a distance greater than the longitudinal dimension of first stack 120. A series of second tabs 174 are similarly supported on second chain 22, and the first and second tabs are arranged in transversely aligned tab pairs. First and second chains 20 and 22 run substantially the length of longitudinal table section 132 and are supported beneath the table. Drive sprockets 34 and 38 are rotated counterclockwise as viewed in FIG. 2, thus to move the upper horizontal portion of the chains from right to left. Tabs 172 and 174 extend upwardly from these horizontal chain portions through slots 136 and 138, respectively, and thus will encounter trailing edge 128 and move the stack leftward with the chains as drive sprockets 34 and 38 are rotated.

The longitudinal and transverse table sections converge at a first collating station, where a longitudinal ramp 176 is formed in the table downstream from, and on but one transverse side of, first knife 146. Third and fourth slots 178 and 180 are formed in the table and ramp directly above the third and fourth endless chains. Mounted below table section 134 beyone ramp 176 is an alignment stop 182, controlled by an alignment stop pneumatic cylinder 184, to reciprocate between an extended position above table 130 as shown in FIG. 4 in broken lines, and a retracted position below the table top.

Figure 5:
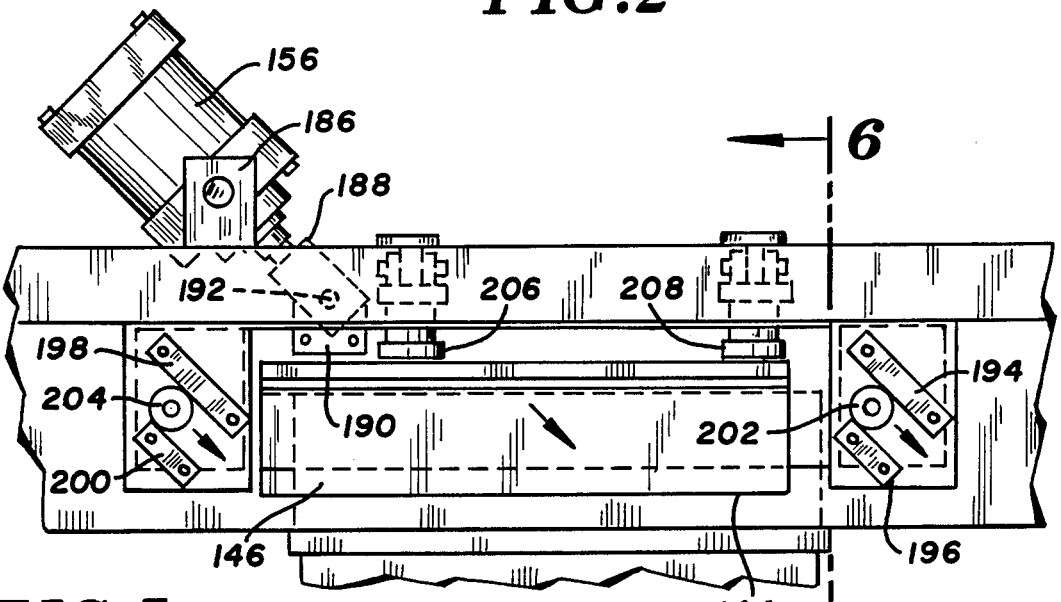
FIG. 5 is an enlarged view of a portion of FIG. 2.

As seen in FIG. 5, pneumatic cylinder 156 is mounted to frame member 158 through brackets 186 and 187. A similar bracket on the opposite side of the cylinder is not shown. Attached to the piston of cylinder 156 is a clevis 188 which in turn is attached to a knife bracket 190 through a pin 192. Mounted to frame member 158 near opposite ends of knife 146 are two guide assemblies including inclined guide bars 194 and 196, and opposite inclined guide bars 198 and 200. Bearings 202 and 204, mounted to knife 146, travel in the path defined by their respective guide bars as cylinder 156 reciprocates, thus to guide the knife and preserve its substantially horizontal orientation.

Figure 6:
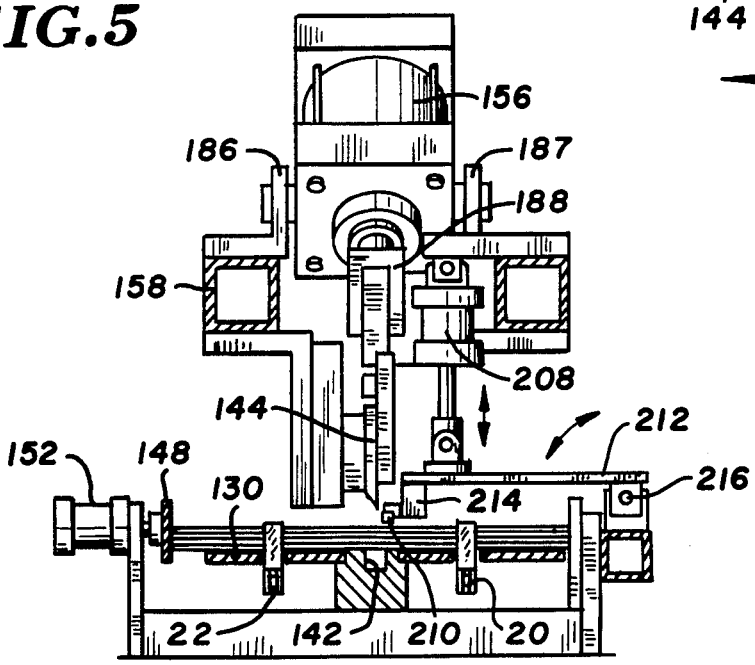
FIG. 6 is a sectional view taken along the line 6—6 in FIG. 5.

A pair of bar control pneumatic cylinders 206 and 208 operate in concert to raise and lower a longitudinal hold bar 210. Bar 210 is mounted to a pair to a pair of pivot arms 212 by a pair of brackets 214, the arms pivoting with respect to the table at pivot pins 216. The extension of pistons of cylinders 206 and 208 rotates arms 212 counterclockwise as viewed in FIG. 6, to bring bar 210 downward on stack 120 and hold it firmly in place during cutting. Retraction of the pistons rotates the arms clockwise to raise the bar and free the stack to proceed along the longitudinal path.

FIG. 7 shows in side elevation the transverse path. Second and third cutting pneupatic cylinders 218 and 220, mounted on a second frame member 222 at an approximately 45° angle with respect to table 130, work in concert to raise and lower a second knife 224. Second knife 224 includes two blades aligned with one another and extended in the transverse direction: a second blade 226 at a second cutting station, and a third blade 228 at a third cutting station.

Driven axle 68 is positioned such that third and fourth endless chains 24 and 26 extend beyond the second cutting station, and overlap with fifth and sixth endless chains 28 and 30 at second collating station. Chains 28 and 30 carry cut material downstream to upper and lower receiving trays 230 and 232, where the material is collated into a final stack of sheet sections. These final stacks are carried from device 16 on an endless conveyor 234, to which is connected a plurality of spaced apart conveyor tabs 236 for moving the final stacks to further processing, if desired. An idler sprocket 238, mounted on a spring biased arm, maintains chain 26 in a desired tension to prevent slippage. A similar sprocket, not shown, maintains third endless chain 24.

Figure 9:
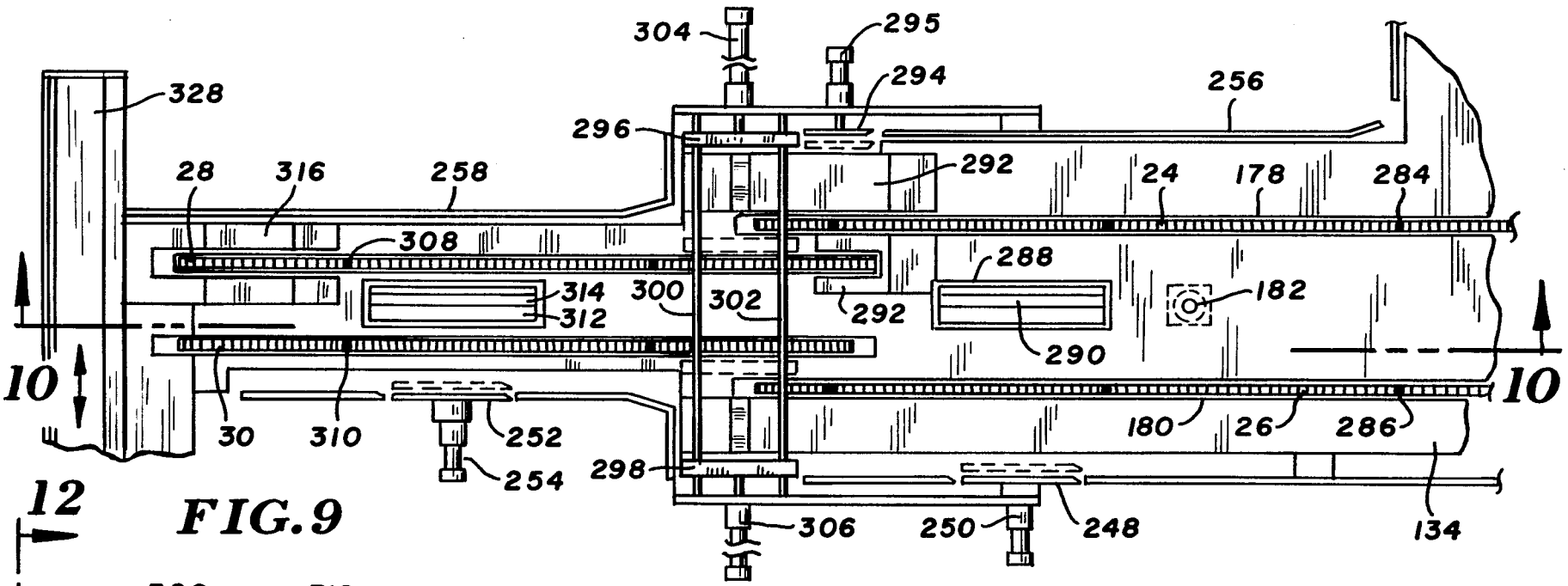
FIG. 9 is a sectional view taken along the line 9—9 in FIG. 7.

FIG. 8 shows second knife 224 including second and third blades 226 and 228. At each cutting station is a pneumatically controlled bar which, when lowered, holds sheet material against table 130 during cutting. A first transverse bar 240 is controlled by a first transverse bar cylinder 242 mounted to second frame member 222, while a second transverse bar 242 is controlled by a second transverse bar cylinder 246, also mounted to the second frame member. A first transverse platen 248 is movable in the longitudinal direction into and out of the transverse path by a first transverse platen cylinder 250, as is a second transverse platen 252 movable by a second transverse platen cylinder 254. Transverse platens 248 and 252 urge sheet material against reference surfaces provided by first and second transverse upright walls 256 and 258, respectively (FIG. 9). FIG. 8 further illustrates the mounting of second and third pneumatic cylinders 218 and 220 to second frame member 222, in second and third brackets 260 and 262, respectively. Second and third clevises 264 and 266 are mounted to second and third knife brackets 268 and 270 directly attached to second knife 224. Guiding knife 224 in its inclined path toward and away from table 130 are bearings 272 and 274 at opposite ends of the blade, which ride in upstream guide bars 276 and 278, and downstream guide bars 280 and 282, respectively.

Figure 10:
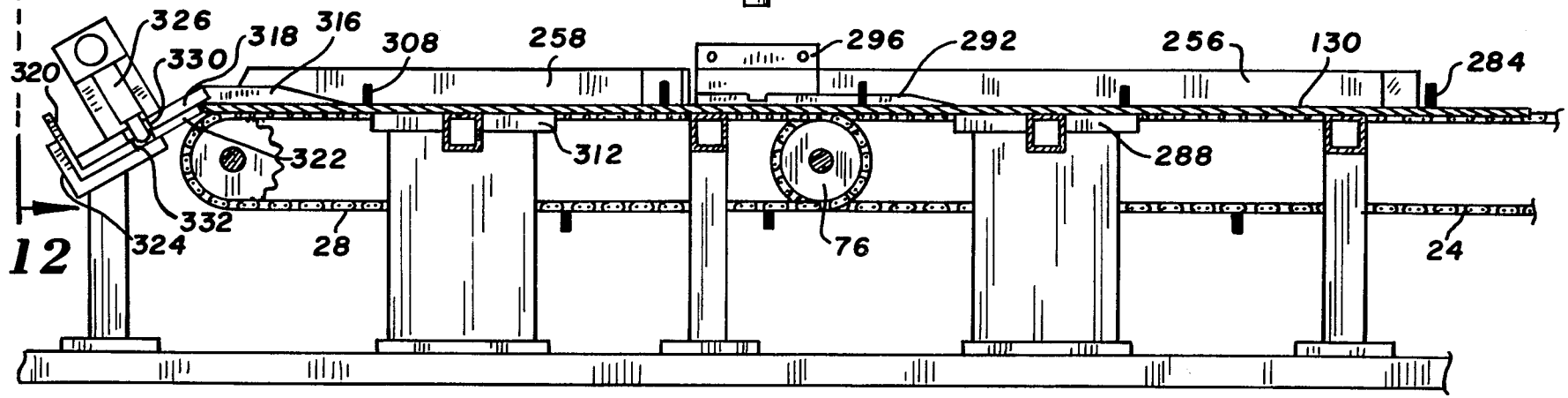
FIG. 10 is a sectional view taken along the line 10—10 in FIG. 9.

As perhaps best seen in FIGS. 9 and 10, third and fourth chains 24 and 26 respectively carry third and fourth tabs 284 and 286, spaced apart and arranged in longitudinally aligned pairs which extend upwardly through third and fourth slots 178 and 180 in order to move stacks along the transverse path. A second anvil 288 in table 130 has a groove 290 extended transversely to receive the second blade. The extent to which first transverse platen 248 is movable longitudinally into and out of the transverse path is shown in broken lines.

The second collating station includes pre-merging and merging apparatus. The pre-merging apparatus includes a first transverse ramp 292, a pre-merge platen 294 movalbe longitudinally into and out of the second path as shown in broken lines, and a pre-merge pneumatic cylinder 295 for controlling platen 294. Downstream of the pre-merge apparatus are opposed first and second merge platens 296 and 298 supported on longitudinally extended guide bars 300 and 302, and reciprocable by first and second merge pneumatic cylinders 304 and 306, respectively as shown by the broken lines.

FIG. 11 shows upper and lower stacks positioned between first and second merge platens 296 and 298 following pre-merge. As indicated at 307, there is a slight overlap of the inside portions of the stacks. Upstream of merge platen 296, the upper stack is supported by ramp 292 as indicated by the broken line at 292*a*. It can be appreciated that in order to completely merge the upper and lower stacks, merge platens 296 and 298 will travel inwardly beyond endless chains 24 and 26. However, as these chains are momentarily stopped during merge, and in a position such that none of the third and fourth tab pairs extends upwardly through slots 178 and 180 near platens 296 and 298, there is no potential for tab/platen interference during the merge stroke.

Fifth and sixth endless chains 28 and 30 are positioned to carry material, once merged by the merge apparatus, further downstream. For this purpose chains 28 and 30 are positioned more closely to one another than are third and fourth chains 24 and 26. Chains 28 and 30 carry pluralities of fifth and sixth tabs 308 and 310, respectively, arranged in longitudinally aligned pairs, to move stacks past the third cutting station to a final collating station.

The third cutting station includes a third anvil 312 having a third groove 314 for receiving third blade 228. Broken lines show the extension of second transverse platen 252 into the second path in order to urge sheet material against second upright wall 258.

Beyond the third cutting station is a second transverse ramp 316, from which stacks are moved to upper receiving tray 230. Adjacent material not raised by ramp 316 is carried to lower receiving tray 232. Upper tray 230 includes a downwardly inclined ramp surface 318 an upwardly inclined stop 320 for the collection of sheet stacks. A lower ramped surface 322 and stop 324 function similarly in lower tray 232. A tongue 326, depended from a support bar 328 and reciprocable longitudinally from one end of the bar to the other, extends into grooves 330 and 332 provided in the upper and lower trays, respectively. When tongue 326 is moved from left to right as viewed in FIG. 12, it moves the stack from upper tray 230 to the top of the stack held in lower tray 232, and moves the combined stack across lower tray 232 to a stop location defined by an upright bracket 334, where the completed stack is carried away by endless conveyor 234. Following deposit of the completed stack, tongue 326 is returned to its initial position for collating and moving subsequent stack portions.

The operation of cutting and collating device 16 can be summarized in connection with FIG. 1. Broken lines in the figure form rectangles, each of which represents a stack of sheets of a material, for example paper. In actual operation, multiple stacks are processed simultaneously, and each rectangle would represent a separate stack. However, understanding of device 16 is facilitated if each broken line rectangle is viewed as the same stack, but at different stages in its processing. With this in mind, first sheet stack 120 is fed to device 16 in the selected orientation, i.e., with the longest dimension of stack 120 oriented longitudinally. The stack is conveyed longitudinally toward the first cutting station, where first knife 146 cuts the stack longitudinally, while it is held at rest by bar 210, to form left and right first stack portions 336 and 338. These stack portions are conveyed together to the first collating station, where right stack portion 338 is raised upward as it travels on longitudinal ramp 176, while left stack portion 336 remains at the general table level. Right stack portion 338, thus elevated, is completely above left stack portion 336 in the sense that its bottom is above the top of stack portion 336.

With third and fourth chains 24 and 26 moving, a pair of tabs 284 and 286 soon encounter the trailing longitudinal edge of right stack portion 338, to move that stack portion onto stack portion 336 and, with the aid of alignment stop 182, combine the stack portions into a single second stack 340. Stop 182 is retracted, permitting chains 24 and 26 to carry second stack 340 along transverse table section 134 to the second cutting station, where second blade 226 cuts stack 340 in the transverse direction. First transverse bar 240 is momentarily lowered to hold stack 340 in place during cutting and, because second blade 226 approaches table 130 at a 45° inclination, a shear component is present which improves cutting.

The cutting creates upper and lower second stack portions 342 and 344, which are conveyed from the second cutting station to the second collating station where upper stack portion 342 is moved onto first transverse ramp 292 and therefore elevated, while lower stack portion 344 remains at the general table level. Further, as upper stack portion 342 is moved approximately half-way up ramp 292, pre-merge platen 294 is moved longitudinally inward, thus to cause upper stack portion 342 to slightly overlap lower stack portion 344. While the amount of overlap is not critical, overlap of approximately 20% of the longitudinal dimension of stack portion 344 has proved satisfactory.

With at least a slight overlap thus being established, stack portions 342 and 344 are moved further downstream and positioned between merging platens 296 and 298, with now only a slight trailing portion of upper second stack portion 342 supported by ramp 292. Merging platens 296 and 298 are then activated, with third and fourth endless chains 28 and 30 momentarily halted, to push stack portions 342 and 344 together and thus merge them together to a single third stack 346.

Third stack 346 then is conveyed transversely to the third cutting station, where third blade 228 cuts it transversely into upper and lower third stack portions 348 and 350. The third stack portions are simultaneously conveyed to the third collating station, where upper third stack portion 348 is elevated on ramp 316 and deposited into upper tray 230, while lower third stack portion 350 is maintained at the table level and deposited into lower receiving tray 232. Finally, tongue 326 is moved as previously described to collate stack portions 348 and 350 into a single final stack 352.

Thus, each sheet in first sheet stack 120 is divided into eight smaller sheets, which are collated to form a single, final stack. Since each cutting station utilizes only one blade, the blade mounting and alignment procedure consists merely of positioning and attaching one blade, as opposed to the more complex, multiple blade systems. The use of ramps to elevate one stack and pushing means to merge upper and lower stacks eliminates the need for belt twisters or other complex mechanisms for turning cards on edge, which not only increases reliability but reduces the risk of damage to individual sheets and sheet sections. Use of a single motor to operate all chain pairs, and further to operate the controller, ensures that all cutting and collating operations will be substantially synchronized, with clutches providing for fine adjustment of chains where necessary.

What is claimed is:

1. An apparatus for dividing sheets of material into pluralities of comparatively smaller sheet sections, and for collating the smaller sheet sections, including:

means forming a longitudinally directed first path, and a transversely directed second path beginning at a downstream end of the first path;

a first conveying means for moving a first stack longitudinally on said first path, each stack including at least one sheet of material with all sheets in the stack aligned in a predetermined orientation;

a first cutting means along said first path for cutting the first stack in the longitudinal direction to form two first stack portions;

said first conveying means further adapted for moving the first stack portions simultaneously and longitudinally on said first path from said first cutting means to a first collating station at the downstream end of the first path, thereby to elevate one of said first stack portions above the other first stack portion;

a first alignment means at the first collating station for vertically aligning said first stack portions, with the elevated first stack portion directly on top of the other first stack portion, to combine said stack portions into a single second stack, said first alignment means including a second conveying means for moving the second stack in the transverse direction on the second path;

a second cutting means along said second path for cutting the second stack in the transverse direction to form two second stack portions;

said second conveying means further adapted for moving the second stack portions simultaneously and transversely on the second path from the second cutting means to a second collating station, thereby to elevate one of the second stack portions above the other second stack portion; and a second alignment means at the second collating station, including a pre-merging means for moving the elevated second stack portion toward the other second stack portion in the longitudinal direction to cause the elevated second portion to at least slightly overlap the other second stack portion, said second alignment means further including a merging means downstream of said pre-merging means for merging the second stack portions to form a single third stack of sheet sections.

2. The apparatus of claim 1 further including:

a third conveying means downstream of the second alignment means for moving the third stack in the transverse direction on the second path;

a third cutting means along said second path and downstream of the second cutting means for cutting the third stack in the transverse direction to form two third stack portions;

said third conveying means further adapted for moving the third stack portions simultaneously and transversely on the second path from the third cutting means to a third collating station, thereby to elevate one of the third stack portions above the other third stack portion; and a third alignment means at the third collating station for merging said third stack portions into a single fourth stack of sheet sections.

3. The apparatus of claim 2 wherein:

said means for forming said first and second paths includes a table having a longitudinal section forming said first path and a transverse section forming said second path.

4. The apparatus of claim 3 wherein:

the first conveying means includes a first pair of endless chains mounted below the table to move in the longitudinal direction, and a plurality of first tabs carried on each chain and spaced apart from one another a distance greater than the longitudinal dimension of the first stack, said first tabs arranged in transversely aligned tab pairs, one of said tab pairs engaging a first transverse edge of the first stack, thereby to move the first stack longitudinally with the chains.

5. The apparatus of claim 4 wherein:

said first pair of chains runs substantially the length of the first path.

6. The apparatus of claim 5 wherein:

the first alignment means includes a second pair of endless chains mounted below the table to move in the transverse direction, and a plurality of second tabs carried on each second chain and arranged in longitudinally aligned second tab pairs, one of said second tab pairs engaging the first longitudinal edge of the elevated first stack portion to move said first elevated stack portion onto the other first stack portion to form said second stack, and further to move said second stack transversely with said second endless chain pair.

7. The apparatus of claim 6 wherein:

siad first alignment means further includes a stop means mounted with respect to said transverse section of the table, and reciprocable into and out of said transverse path to cooperate with one of said second tab pairs in aligning said first stack portions when in the transverse path, and permitting transverse movement of said second stack past itself when out of said transverse path.

8. The apparatus of claim 7 wherein:

said third conveying means includes a third pair of endless chains mounted below the table to move in the transverse direction, and a plurality of third tabs carried on each chain of the third pair and arranged in longitudinally aligned third tab pairs, one of said third tab pairs engaging the first longitudinal edgeof the third stack to move it transversely with said third chain pair.

9. The apparatus of claim 8 wherein:

the chains in said third pair and the chains in said second pair overlap one another at said second collating station, and wherein the chains of said third pair are closer to one another than the chains of said second pair.

10. The apparatus of claim 2 wherein:

siad first cutting means includes a first knife having a longitudinally extended blade, and means for supporting the knife over said table for movement toward and away from said table.

11. The apparatus of claim 10 wherein:

said knife is supported for movement toward and away from said table along a path inclined at an angle of about 45° relative to the table.

12. The apparatus of claim 11 wherein:

the means for supporting said knife includes a rotatable first bearing at each end of a knife, a pair of elongate first guide bars associated with each first bearing and mounted with respect to said table at said angle, and a first pneumatic cylinder for reciprocating said knife, each of said first bearings being constrained to move in its associated pair of elongate first guide bars.

13. The apparatus of claim 12 wherein:

said second and third cutting means are comprised of a second knife having second and third transversely extended blades, and means for supporting said second knife for movement toward and away from said table.

14. The apparatus of claim 13 wherein:

said means for supporting said second blade include two rotatable second bearings, one mounted at each end of the second blade, and a pair of elongate second guide bars associated with each second bearing and mounted at an angle of about 45° with respect to the table, and second and third pneumatic cylinders for reciprocating the second knife, each of said second bearings being constrained to move between its associated pair of second guide bars.

15. The apparatus of claim 14 including;

a first ramp formed in said table at the first collating station and directed longitudinally downstream and upward to a level above the general level of the first path, said first ramp positioned to be encountered only by said elevated first stack portion as the first stack portions enter said first collating station.

16. The apparatus of claim 15 further including:

a second ramp formed in said table at the second collating station and directed transversely downstream and upward to a second ramp level above the general level of the second path, and positioned to be encountered only by said elevated second stack portion as said second stack portions enter the second collating station.

17. The apparatus of claim 16 wherein:

said pre-merging means include a first platen mounted at the second collating station, and a fourth pneumatic cylinder for reciprocating said first platen longitudinally into and out of said second path a distance substantially less than the longitudinal dimension of said elevated second stack portion, and positioned to engage the outside transverse edge of said elevated second stack portion and move said second elevated stack portion longitudinally to cause it to overlap the other second stack portion.

18. The apparatus of claim 17 wherein:

said merging means include second and third opposed platens mounted downstream of said first platen, and fifth and sixth pneumatic cylinders for reciprocating said second and third platens, respectively, longitudinally into and out of said second path, said second and third platens positioned to engage the respective transverse outer edges of the second stack portions, and move the second stack portions towards one another to merge them into said third stack.

19. The apparatus of claim 18 including:

an electric motor drivably engaged with said first, second and third pairs of endless chains.

20. The apparatus of claim 19 including:

an adjustment means for varying the speed of said first pair of endless chains with respect to the speed of said second and third pairs of endless chains.

21. The apparatus of claim 20 including:

a plurality of cams, rotated by said motor, for activating and de-activating said first, second, third, and fourth, fifth and sixth pneumatic cylinders, each at its own selected times.

22. A process for dividing sheets of material into pluralities of comparatively smaller sheet sections, including the steps of:

aligning one or mroe substantially equally sized material sheets in a first stack and in a predetermined orientation;

conveying said first stack in a longitudinal direction to a first cutting station, and cutting said stack in the longitudinal direction to form two first stack portions;

conveying said first stack portions, simultaneously and longitudinally, to a first collating station, and elevating one of said first stack portions above the other first stack portion;

pushing a first longitudinal edge of the elevated first stack portion in a transverse direction onto the other first stack portion and aligning and combining said first stack portions into a single second stack;

conveying the second stack in a transverse direction to a second cutting station, and cutting said second stack in the transverse direction to form two second stack portions;

conveying said second stack portions, simultaneously and in the transverse direction, to a second collating station and elevating one of the second stack portions above the other second stack portion;

pushing siad elevated second stack portion in the longitudinal direction toward the other second stack portion to cause at least a slight overlap of the elevated second stack portion over the other second stack portion; and after further movement of said second stack portions in said transverse direction, simultaneously pushing said second stack portions toward one another in the longitudinal direction thereby to merge the second stack portions into a single third stack of sheet sections.

23. The process of claim 22 including the further steps of:

conveying said third stack in the transverse direction to a third cutting station downstream of the second cutting station, and cutting the third stack in the transverse direction to form two third stack portions;

conveying said third stack portions simultaneously and transversely to a third collating station, and elevating one of the third stack portions above the other third stack portion; and pushing a transverse edge of the elevated third stack portion to move it in the longitudinal direction onto the other third stack portion to combine said third stack portions into a single fourth stack of reduced sized sheet sections.

* * * * *